US008087511B2

(12) United States Patent
Libit et al.

(10) Patent No.: US 8,087,511 B2
(45) Date of Patent: Jan. 3, 2012

(54) CUP CARRIER

(75) Inventors: Sidney M. Libit, Longboat Key, FL (US); Jeanne E. Libit, Great Falls, VA (US); Jeffrey M. Libit, Albuquerque, NM (US)

(73) Assignees: Sidney M. Libit, Longboat Key, FL (US); Jeanne E. Libit, Great Fall, VA (US)

( * ) Notice: Subject to any disclaimer, the term of this patent is extended or adjusted under 35 U.S.C. 154(b) by 486 days.

(21) Appl. No.: 11/872,439

(22) Filed: Oct. 15, 2007

(65) Prior Publication Data

US 2008/0087558 A1 Apr. 17, 2008

Related U.S. Application Data

(63) Continuation-in-part of application No. 11/077,546, filed on Mar. 11, 2005, now abandoned.

(60) Provisional application No. 60/552,194, filed on Mar. 12, 2004.

(51) Int. Cl.
*B65D 71/00* (2006.01)
*B65D 71/40* (2006.01)

(52) U.S. Cl. ..... 206/162; 206/197; 206/199

(58) Field of Classification Search ..... 206/200, 206/196, 194, 549, 139, 162, 170, 171, 174, 206/175, 193, 197, 199, 141; 294/159, 146, 294/143, 142; 220/738, 741, 742
See application file for complete search history.

(56) References Cited

U.S. PATENT DOCUMENTS

| | | | | | |
|---|---|---|---|---|---|
| 1,448,866 | A | | 3/1923 | George | |
| 1,910,168 | A | * | 5/1933 | Jacobs | 294/142 |
| 1,981,647 | A | * | 11/1934 | Johnson | 206/766 |
| 2,513,762 | A | | 7/1950 | Tyson, Jr. | |
| 3,094,259 | A | | 6/1963 | Diehl | |
| 3,565,323 | A | * | 2/1971 | Katzenmeyer | 229/117.14 |
| 3,682,369 | A | | 8/1972 | Isakson | |
| 4,399,939 | A | | 8/1983 | Tunick | |
| 5,127,519 | A | * | 7/1992 | Tsao | 206/142 |
| 5,267,644 | A | * | 12/1993 | Tsao | 206/151 |
| 5,624,024 | A | * | 4/1997 | Miess | 206/172 |
| 5,738,217 | A | | 4/1998 | Hunter | |
| 5,746,310 | A | | 5/1998 | Slomski | |
| 5,803,264 | A | * | 9/1998 | Gersten et al. | 206/549 |
| 5,927,502 | A | * | 7/1999 | Hunter | 206/549 |
| 5,957,276 | A | * | 9/1999 | Cutler et al. | 206/194 |
| 6,230,882 | B1 | * | 5/2001 | Wischusen, III | 206/194 |
| 6,298,992 | B1 | * | 10/2001 | Tsao | 206/549 |
| 6,394,265 | B1 | * | 5/2002 | Tsao | 206/217 |
| 2003/0071045 | A1 | * | 4/2003 | Taylor | 220/737 |
| 2003/0159950 | A1 | | 8/2003 | Jones et al. | |
| 2003/0213705 | A1 | | 11/2003 | Woog | |

* cited by examiner

*Primary Examiner* — Steven A. Reynolds
(74) *Attorney, Agent, or Firm* — Michael Best & Friedrich LLP

(57) ABSTRACT

A carrier for one or a plurality of beverage containing cups such as those supplied to carry out customers of carry out restaurants, fast food restaurants and the like. The cup carrier constructed in accordance the present invention includes a one piece blank which can be folded to form a base with one or a plurality of openings for receiving a beverage cup to provide an easily set up cup carrier that stably suspends the cup or cups in an upright position when the carrier is supported by a handle structure positioned above the cups so that the force of gravity will maintain the cup or cups in an upright suspended position. A paddle insert is used to expand the number of cups that can be held by the cup carrier.

6 Claims, 17 Drawing Sheets

CUP CARRIER

RELATED APPLICATIONS

This patent application is a continuation-in-part of U.S. patent application Ser. No. 11/077,546, filed on Mar. 11, 2005, which claims the priority of U.S. Provisional Application No. 60/552,194, filed Mar. 12, 2004, the contents of both of which are incorporated herein by reference.

BACKGROUND OF THE INVENTION

1. Field of the Invention

The present invention generally relates to a carrier for one or a plurality of beverage containing cups such as those supplied to carry out customers of carry out restaurants, fast food restaurants and the like. The cup carrier constructed in accordance the present invention includes a one piece blank which can be folded to form a base with one or a plurality of openings for receiving a beverage cup or cups to provide an easily set up cup carrier that stably suspends the cup or cups in an upright position when the carrier is supported by a handle structure positioned above the cups so that the force of gravity will maintain the cup or cups in an upright suspended position.

2. Description of the Related Art

Spillage of beverages from hand carried cups is a well known problem to customers of carry out or fast food restaurants. Even when beverage cups are provided with a frictionally attached closure lid, it is difficult for a customer to carry a beverage cup or cups without spilling the beverage contents, especially when also carrying food products in a bag or the like during normal handling and transportation to a site of consumption of the beverage.

Various efforts have been made to facilitate the transportation of multiple cups from a point of purchase to a point of use. Such efforts include, placing the cups in an upright position in a paper bag which frequently results in the beverage cup tilting over and spilling the beverage internally of the bag. Another effort includes the provision of a compartmented tray constructed of cardboard or similar material to receive and frictionally engage the bottom ends of a plurality of beverage cups. While the use of such trays is more effective than using a paper bag and more effective than a customer gripping and carrying a plurality of cups in their hands, such trays provide a somewhat unstable carrier since the cups tend to tilt out of the trays especially if the trays are tilted or come into contact with a door, door frame or other stationery building structure, vehicle body or the like.

SUMMARY OF THE INVENTION

The cup carrier in accordance with the present invention includes a one piece carrier preferably constructed of stiff cardboard, such as corrugated cardboard or the like formed from a single blank having a planar base having at least one or a plurality of circular openings therein for receiving one or plurality of tapered beverage cups with the periphery of each circular opening engaging the beverage cup received therein intermediate the ends thereof in order to stably support the beverage cup in an upright position and to prevent the beverage cup from tilting out of the opening in the base since the frictional engagement between the cup and the periphery of the opening and force of gravity will retain the beverage cup or cups in the openings in the base. Opposite edges of the base include upwardly converging support members which terminate in a handle structure located above the center of the base and the center of any cup or cups being supported by the base with the weight of the cups and beverages and the force of gravity maintaining the base generally in a horizontal position below the handle structure to effectively support a beverage cup or cups in an upright suspended position within the opening or openings in the base of the carrier. In addition, a paddle insert is presented which expands the number of cups that can be held by the cup carrier of the present invention.

Accordingly, an object of the present invention is to provide a one piece cup carrier constructed from a cardboard blank having a central circular opening or a plurality of circular openings formed in a rectangular central portion of the blank when the blank is folded in a manner to form a cup carrier.

Another object of the invention is to provide a cup carrier in which a fold line is provided outwardly from the openings in the base of the cup carrier to enable upwardly extending portions of the blank to converge upwardly to form a handle structure with the upwardly converging handle structure being spaced from any upper lip on the beverage cups or container and also spaced from any closure lid placed thereon to enable suspension of the beverage cups in a vertical position in the base.

A further object of the invention to provide fold lines in the upper portions of the handle structure to enable a short terminal end of each blank to be oriented in contacting relation with an opening formed therein to receive the fingers of a person carrying the cup carrier with the handle structure also being provided with a tab structure to retain the portions of the handles to be engaged by the fingers of a person carrying the carrier in contacting relation to maintain the carrier in a set up position to stably support the beverage cups when the cup carrier is being transported with a beverage cup or cups suspended through the openings in the base of the carrier.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
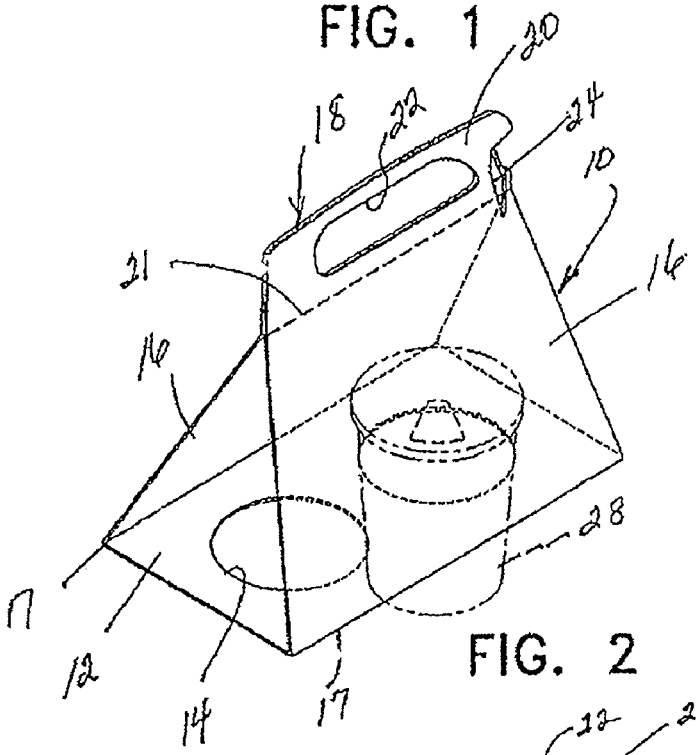
FIG. 1 is a perspective view of a first embodiment of a cup carrier in a set up position with a beverage cup supported therein.

Before any embodiments of the present invention are described, it is to be understood that the invention is not limited in its scope to the embodiments, details of construction, and arrangement of components set forth in the following description of illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

Figure 2:
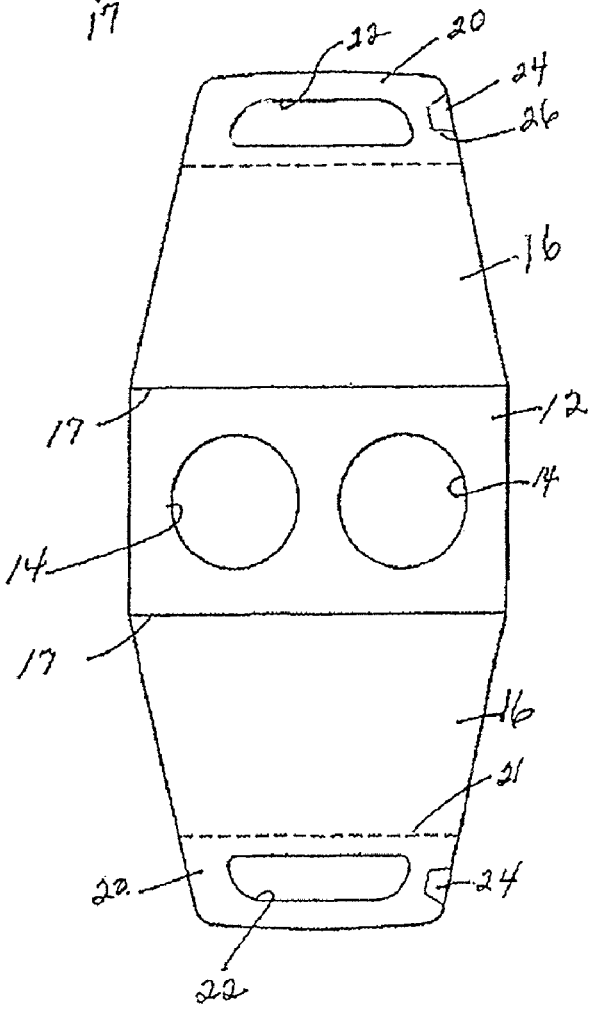
FIG. 2 is a plan view of the cardboard blank from which the cup carrier of FIG. 1 is formed.

FIG. 1 depicts a first embodiment of the cup carrier that is designated by reference numeral 10 and includes a flat base 12 having two circular openings 14 formed therein with upwardly extending support members 16 connected along fold line 17 to each of the side edges of the base 12. The upper end of each support member 16 includes an upwardly extending handle member 20 connected to the support member 16 along fold line 21. Each of the upwardly extending handle members 20 includes an elongated slot like opening 22 therethrough for receiving the fingers of a person carrying the cup carrier 10. The handle structure generally designated by reference numeral 18 includes tabs 24 along at least one side edge of the upwardly extending handle members 20 that can be folded laterally to secure the handle members 20 in adjacent relation when the blank illustrated in FIG. 2 is folded in a manner to form the set up cup carrier 10 illustrated in FIG. 1. the tabs 24 are formed by a pair of inwardly converging cut lines 26 so that the tabs 24 are aligned with each other when the blank is set up to enable the table 24 to be folded into overlying relation to a surface of one of the handle members 20 or folded to a position generally perpendicular to the members 20 as illustrated in FIG. 1 to retain the handle members 20 in adjacent relation and to facilitate insertion of the fingers through the slot like openings 22. In this embodiment, like all of the embodiments described herein, the cup carrier is constructed of one piece and can be set up or assembled without using glue or an adhesive. A cup or cups 28 can be easily dropped into the openings 14 when the blank is flat or the support members 16 folded upwardly after which the handle members 20 are brought together in aligned relation with the support members 16 upwardly converging position. The tabs 24 then can be bent to the position illustrated in FIG. 1 so that the cup carrier with the cups therein can be easily handed to a customer and the customer can easily carry the cup carrier and cups to a desired destination without the cups tilting over or spilling beverages from the cups 28.

As illustrated in FIG. 1, the cup lip normally provided at the upper end of the cup 28 which receives and frictionally secures a cover lid on the cup has a periphery that is spaced from the inner surfaces of the upwardly extending support members 16, thereby assuring that the cup lid will not become dislodged from the upper end of the cup 28 during normal handling of the cup carrier by a customer when carrying the cup carrier and cups to a desired destination.

Figure 3:
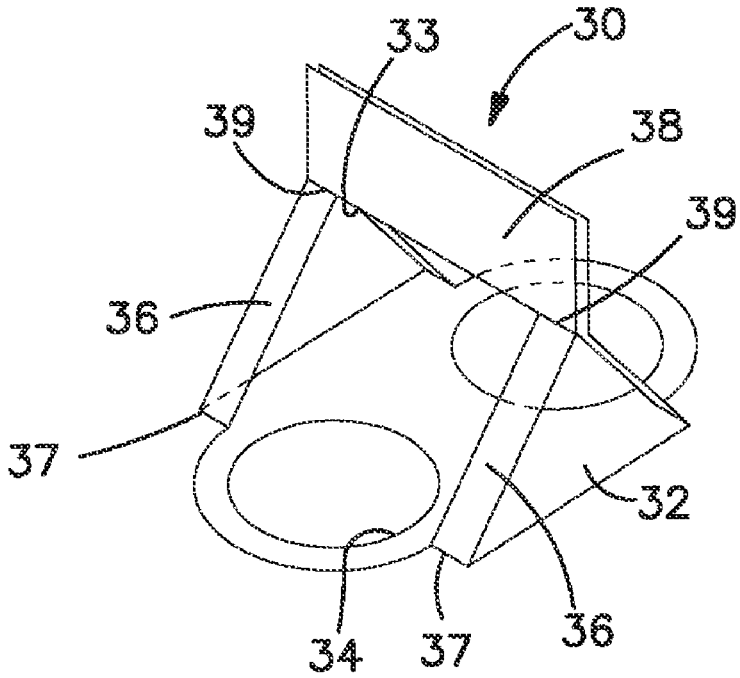
FIG. 3 is a perspective view of a second embodiment of a cup carrier in set up position.
Figure 4:
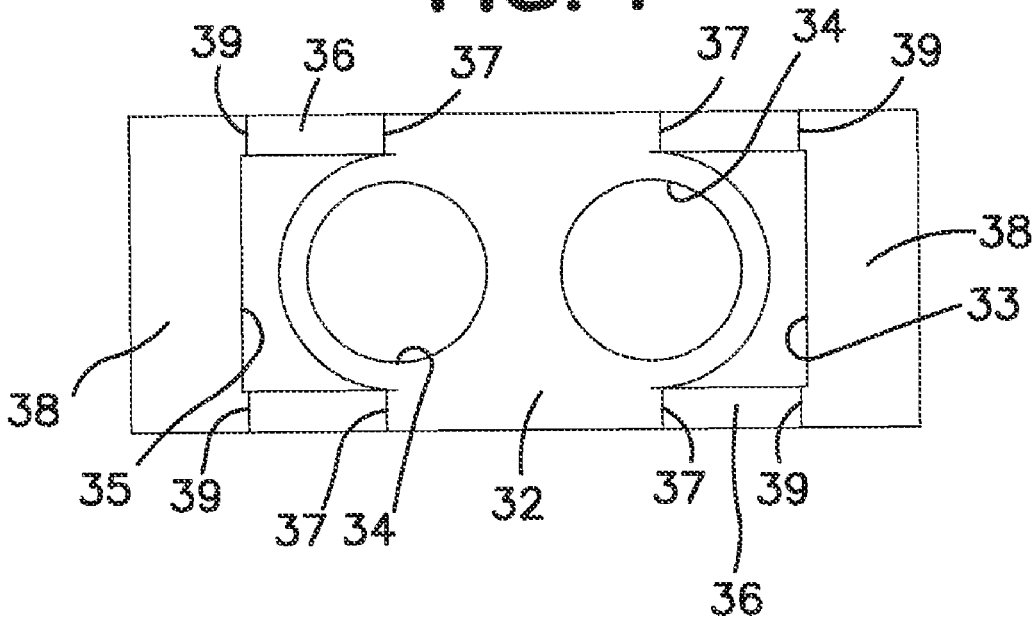
FIG. 4 is a top plan view of the blank from which the cup carrier of FIG. 3 is formed.

FIGS. 3 and 4 depict a second embodiment of the cup carrier that is generally designed by reference number 30 which includes a base 32 that includes two or more circular openings 34 for receiving beverage cups in a manner similar to that of the first embodiment depicted in FIG. 1. A portion of the base 32 outwardly of the outer circumference of each of the circular openings 34 is provided with a cut out area 35 with the outer periphery of an outer portion of the area of the base having the opening 34 formed therein being separated from the side edges and end edges of the opening 35 as illustrated in the blank shown in FIG. 4 from which the cup carrier 30 is formed. Extending upwardly from portions of the base 32 outwardly from the cut out area 35 is a pair of support members 36 connected to the base 32 along fold lines 37 to enable the support members 36 to be folded upwardly into converging relation as illustrated in FIG. 3. The outer end portions of support members 36 include handle members 38 connected to the upwardly converging support members 36 along fold lines 39. The handle members 38 include a lower edge 33 which facilitate insertion of the fingers below the lower edges 33 of the handle members 38 and grip the handle members 38 for effectively carrying cups suspended in the openings 34. The outwardly extending relation of fold lines 37 from the interior or the circular openings 34 provides space for the upper lip of the cup supported by the cup carrier 30 and also provides space for the closure lid provided on the cup so that the closure lid will not be contacted and possibly dislodged during normal transport of the cup carrier 30 and cups therein to a desired destination.

Figure 5:
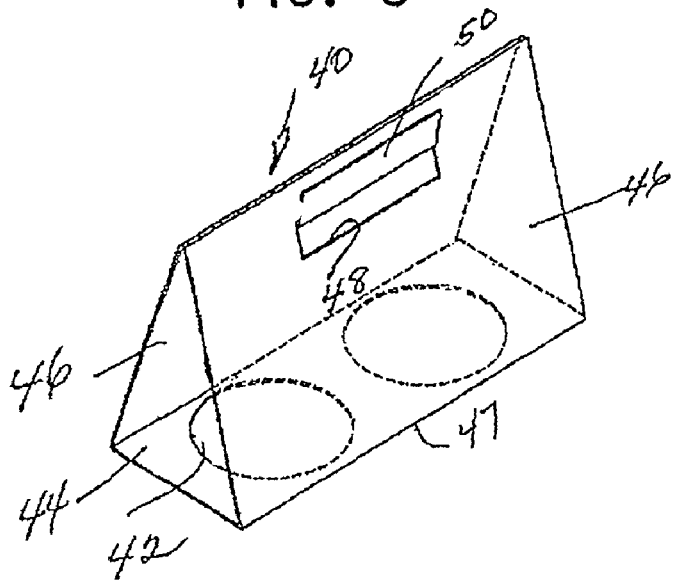
FIG. 5 is a perspective view of a third embodiment of a cup carrier illustrating a handle structure that maintains the cup carrier in set up position.
Figure 6:
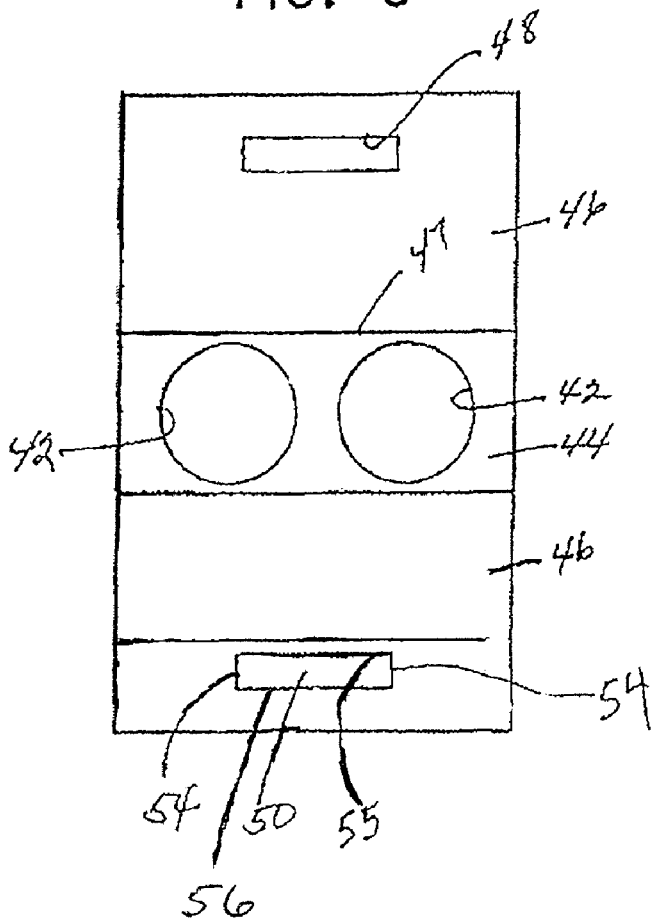
FIG. 6 is a top plan view of the blank from which the cup carrier of FIG. 5 is formed.

FIGS. 5 and 6 depict a third embodiment of the cup carrier that is designated by reference numeral 40 and includes a base 44 having two or more circular opening 42 therein with the side edges of the base 44 being connected to a pair of upwardly converging support members 46 connected to the side edges of base 44 along fold lines 47. The upper edge area of one support members 46 includes an elongated slot like rectangular opening 48 adjacent the upper edge thereof with the slot like opening 48 being generally rectangular in configuration and of sufficient dimensions to receive the fingers of a person carrying the cup carrier 40. The other support member 46 includes a cut out tab 50 having a bottom edge 52, side edges 54 and a top edge 55 connected to the support member 46 along a fold line 56 so that the tab 50 is larger in size than the slot like opening 48 and can be folded through the opening 48 and bent upwardly along the outer surface of a support member 46 as illustrated in FIG. 5. This structure forms an effective handle for carrying the cup carrier 40. The tab 50 retains the upper ends of the support members 46 in adjacent relation to maintain the set up condition of the carrier 40.

Figure 7:
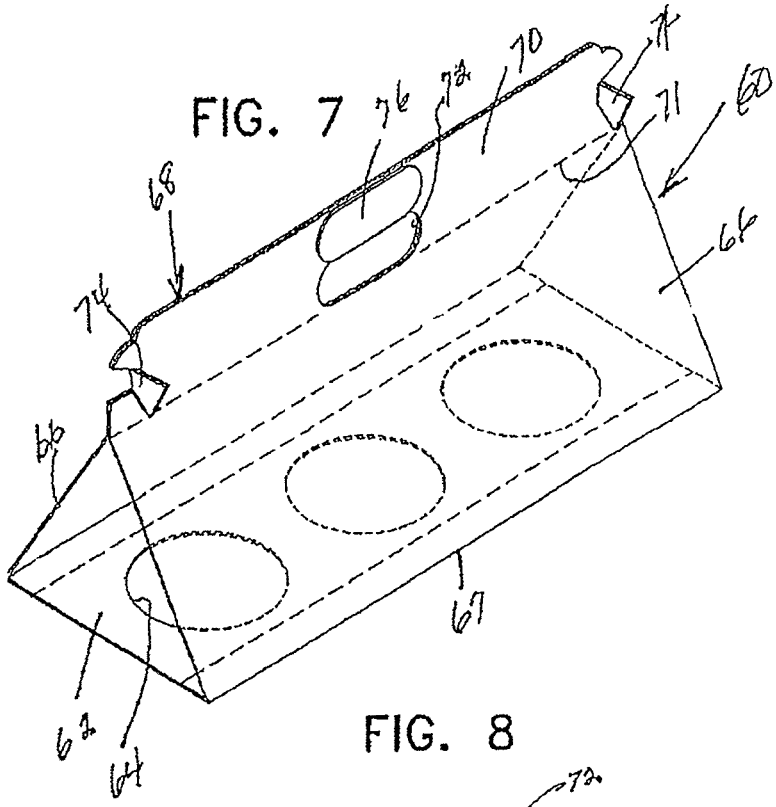
FIG. 7 is a perspective view of a fourth embodiment of a cup carrier in which the base includes three circular openings to receive three beverage cups.
Figure 8:
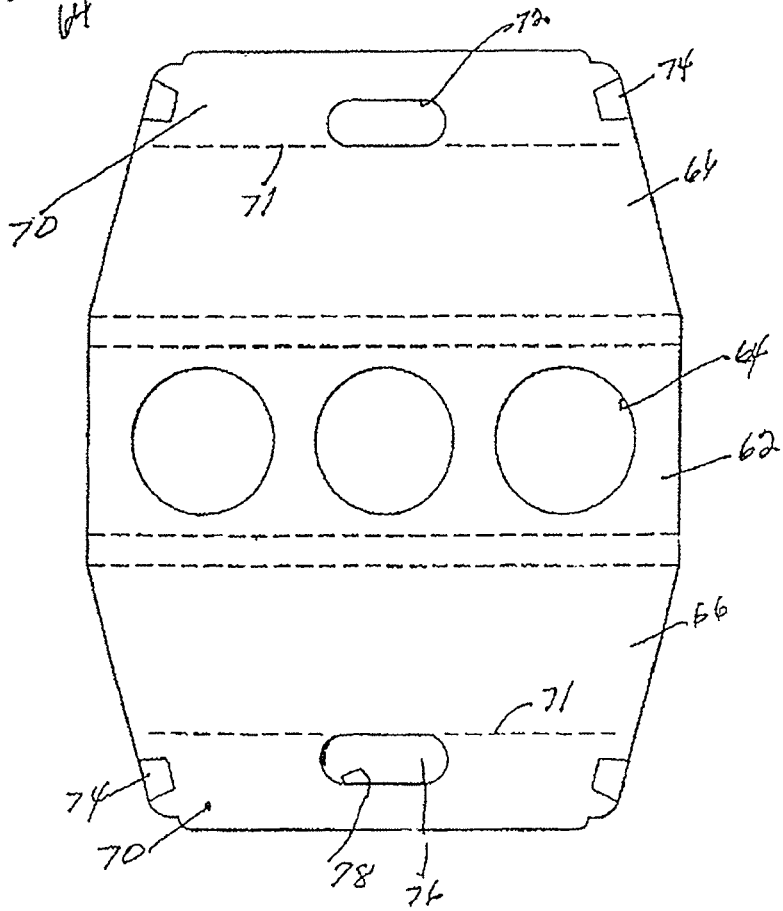
FIG. 8 is a top plan view of the cardboard blank from which the cup carrier of FIG. 7 is formed.

FIGS. 7 and 8 depict a fourth embodiment of the cup carrier that is designated by reference numeral 60 and includes a base 62 of rectangular configuration and elongated sufficiently to form three circular openings 64 therein. As illustrated three openings 64 are provided. However, it is pointed out that any number of cup openings can be provided but most take out orders do not exceed three or four beverage cups. If more cups are to be carried, a second cup carrier can be used to avoid a cup carrier being too large to handle. The carrier 60 includes a pair of upwardly converging support members 66 connected to the side edges of the base 62 by fold lines 67. Each support member 66 terminates in a handle structure generally designated by reference numeral 68 and including a pair of handle members 70 oriented in contacting relation to each other. The side edges of the handle members 70 are provided with cut out bendable tabs 74 similar to the tabs 24 illustrated in FIG. 1 and which functions in the same manner. Also, each of the support members 70 includes a slot like cut out members 72. One of the slot like members 72 retains the cut out area as a tab 76 connected to the upper edge of the slot like opening along a fold line 78 so that the tab 76 can be pushed through the other slot like opening 72 to retain the handle members 70 in contacting relation when the handle member 70 is the opening 72 are aligned and tab 76 on one pushed through and folded upwardly along the outer surface of the other handle member 70 as illustrated in FIG. 7. If desired, the tab 76 can be slightly larger and provided with rounded ends so that it becomes locked in position to retain the handle members 70 in assembled relation to lock the handle structure in view of the large number of beverage cups being carried by the cup carrier 60.

Figure 9:
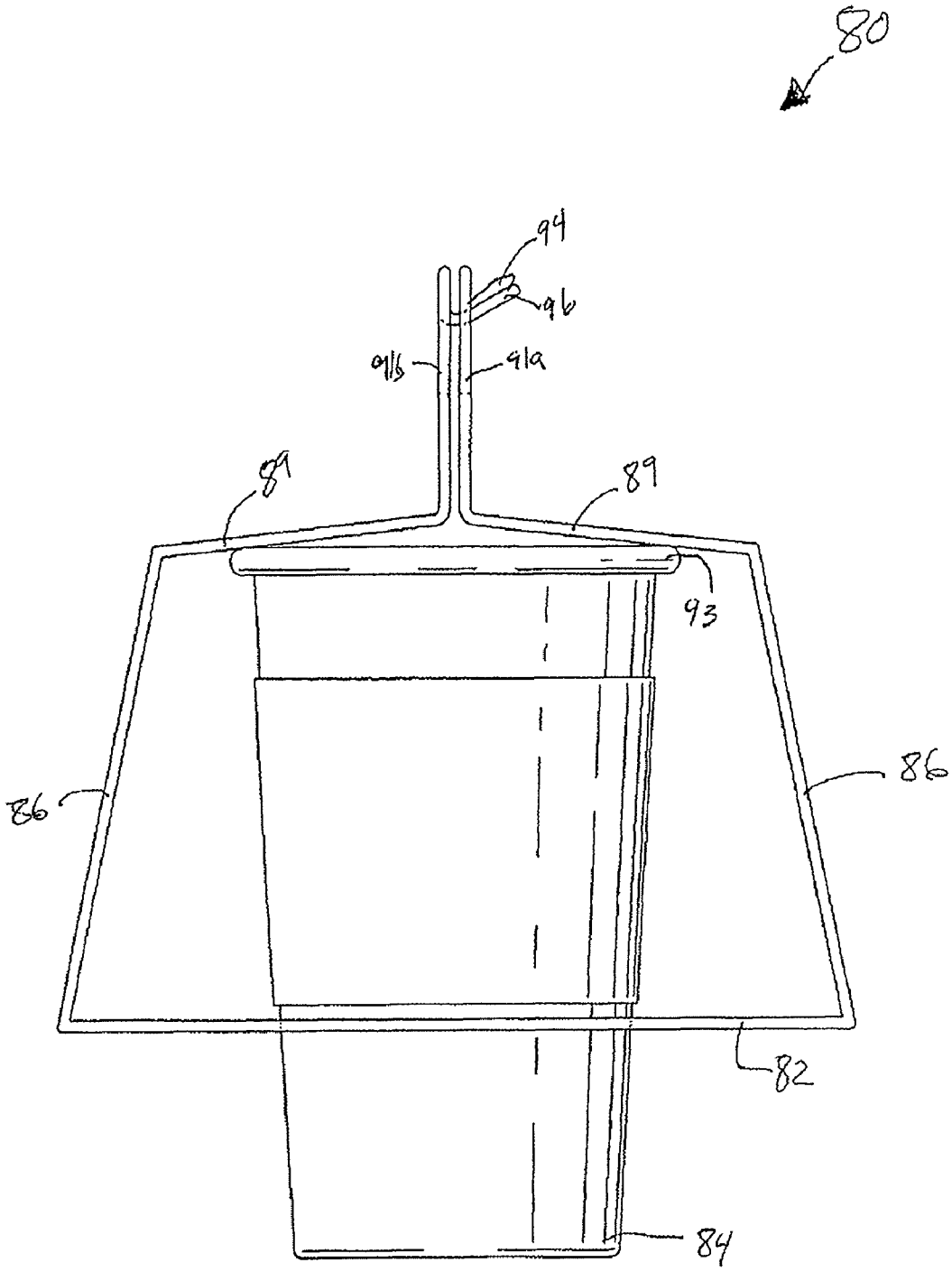
FIG. 9 is a side view of a fifth embodiment of a cup carrier.
Figure 10:
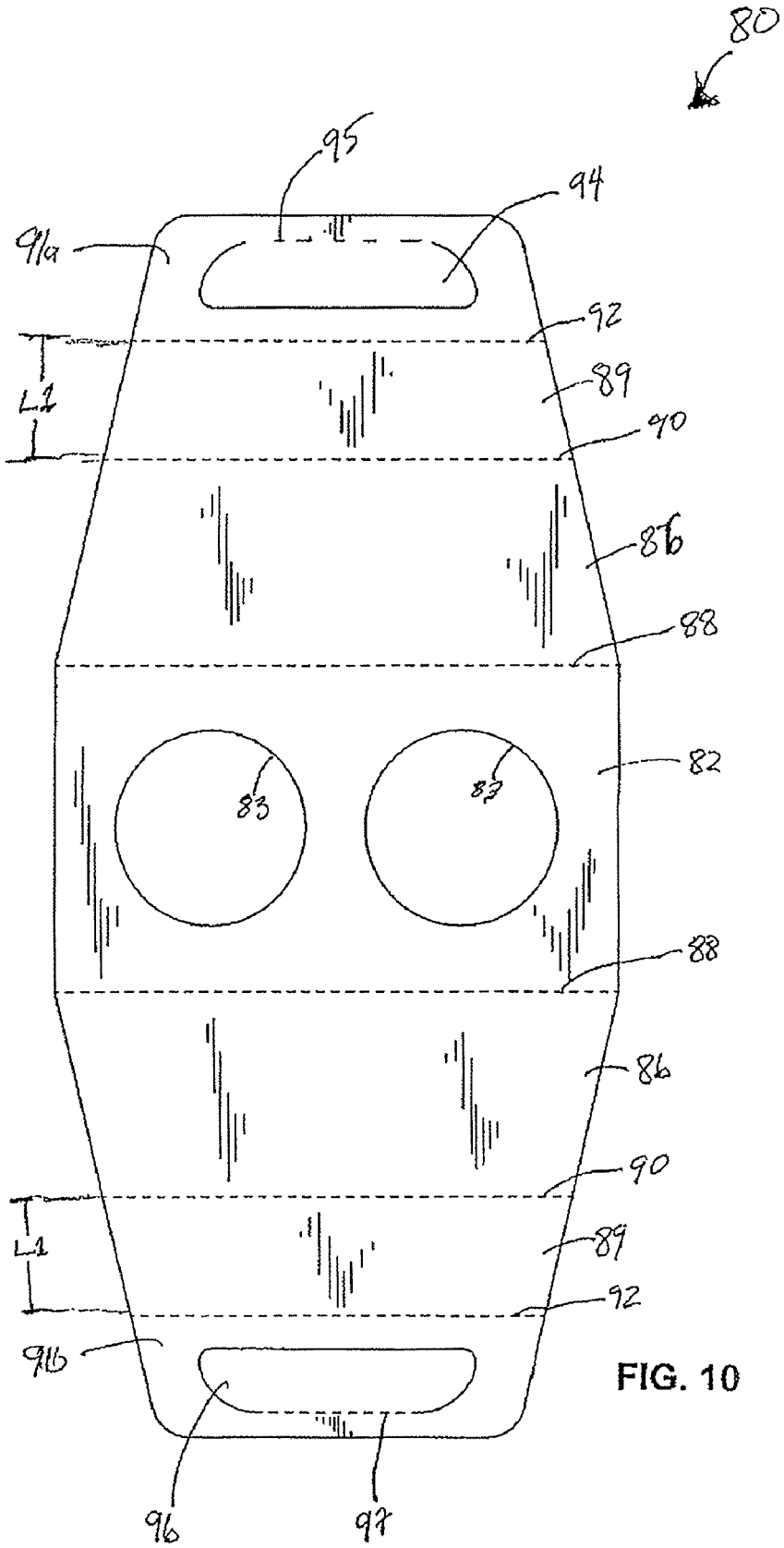
FIG. 10 is a top plan view of the cardboard blank from which the cup carrier of FIG. 9 is formed.

FIGS. 9 and 10 depict a fifth embodiment of the cup carrier that is designated by reference number 80. The cup carrier 80 includes a base 82 with a number of circular openings 83 (e.g., two as shown) suitable for receiving one or more cups 84. In addition, the cup carrier 80 includes two upwardly extending support members 86, which are connected to the base 82 along fold lines 88. Further, upwardly converging roof members 89 are connected to each of the support members 86 along fold line 90. The roof members 89 each terminate at a handle structure 91*a*, 91*b* along fold lines 92. As depicted in FIG. 9, the fold lines 90 are positioned at approximately the same height as the top of the cup 93, so that the upwardly converging roof members 89 are substantially coplanar to and in contact with the top of the cup 93 when the cup carrier 80 sits on a flat surface in its set up condition. In addition, the roof members 89 each have a length L1 which is of sufficient dimension so that when the cup carrier 80 is placed on a flat surface in its set up condition, the support members 86 are not in contact with the cup 84. The dimensions L1 of the roof members as described above insure that the cup carrier can be set up without interference from the cup 84.

The first handle structure 91*a* includes a cut-out tab 94 that is connected to the first handle structure 91*a* along fold line 95. The second handle structure 91*b* includes a cut-out tab 96 that is connected to the second handle structure 91*b* along fold line 97. The opening defined by cut-out tab 94 is of suitable size to receive the fingers of the person carrying the cup carrier 80 and the opening defined by cut-out tab 96 is approximately the same size. When the cup carrier 80 is in its set up condition, the cut-out tab 96 of the second handle structure 91*b* may be pressed against the cut-out tab 94 of the first handle structure 91*a*, folded through the opening defined by the cut-out tab 94 of the first handle structure 91*a*, and folded upwardly. The cut-out tab 96 of the second handle structure 91*b* remains in continued contact with, and overlying relation to, the cut-out tab 94 of the first handle structure 91*a*, causing cut-out tab 94 to be folded upwardly in adjacent relation to the outer surface of the first handle structure 91*a*. Alternatively, the cut-out tab 94 of the first handle structure 91*a* may be pressed against the cut-out tab 96 of the second handle structure 91*b*, folded through the opening defined by cut-out tab 96, and folded upwardly, in continued contact with and overlying relation to cut-out tab 96 in a manner similar to that described above. This embodiment for a handle structure 91*a*, 91*b* forms an effective handle for the cup carrier 80 by frictionally retaining the handle structures 91*a*, 91*b* in adjacent relation to one another, and is suitable for use in other cup carrier embodiments described herein, including the cup carrier embodiments described above with respect to FIGS. 5, 7, 12 and 16.

Figure 11:
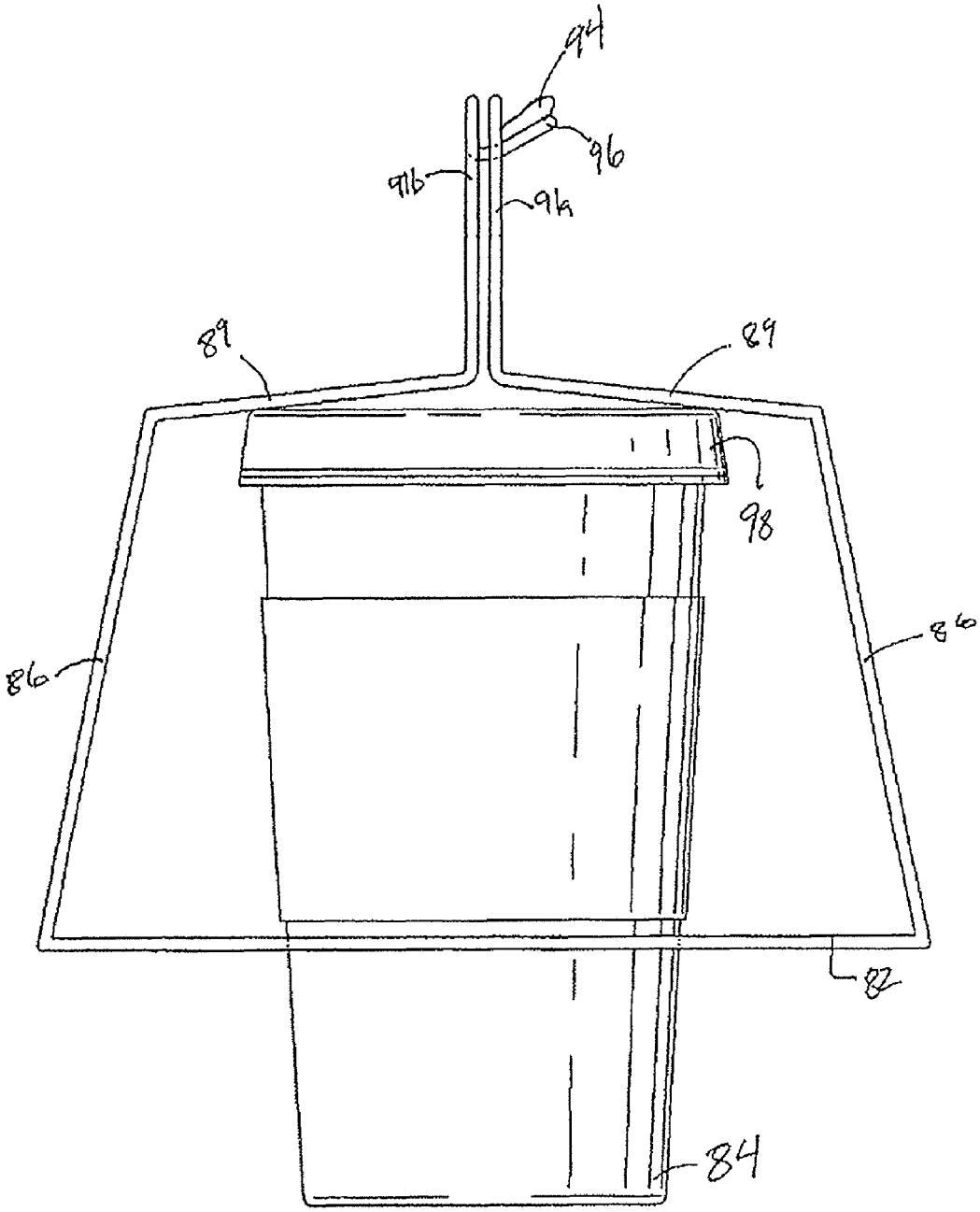
FIG. 11 is a side view of the cup carrier of FIG. 9 depicting a cup with a lid.

This embodiment of the cup carrier 80 increases the stability of the cups 84 of the cups as they are being transported. As shown in FIG. 9, because the upwardly converging roof members 89 are in contact with the top of the cup 93, they exert downward pressure on the cup 84 when the cup carrier 80 is in its set up condition. In addition and as depicted in FIG. 11, if the cups 84 are configured with lids 98, the upwardly converging roof members 89 exert a downward pressure on the lid 98 to help securely hold it in place.

Figure 12:
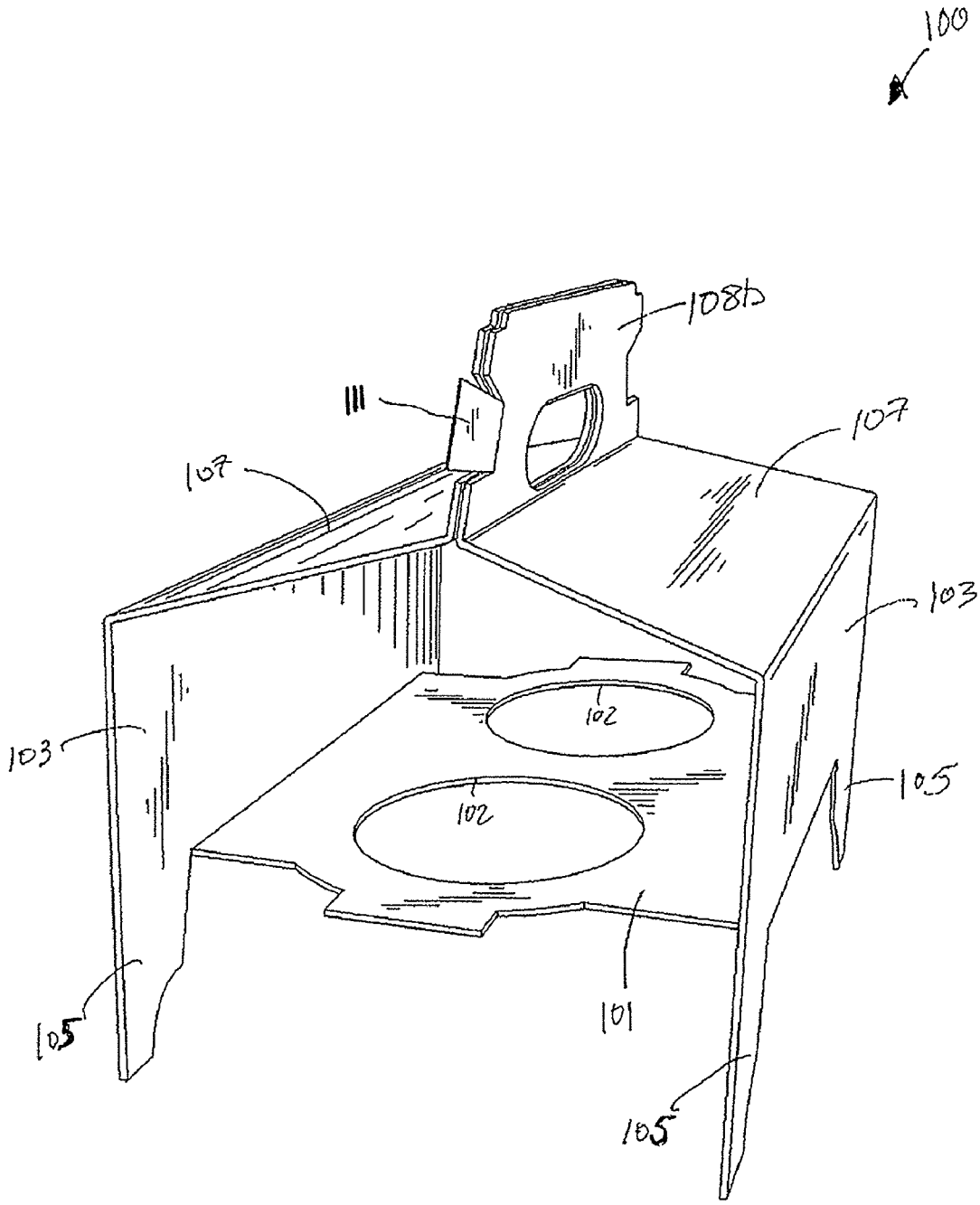
FIG. 12 is a perspective view of a sixth embodiment of a cup carrier that includes downwardly extending feet.
Figure 13:
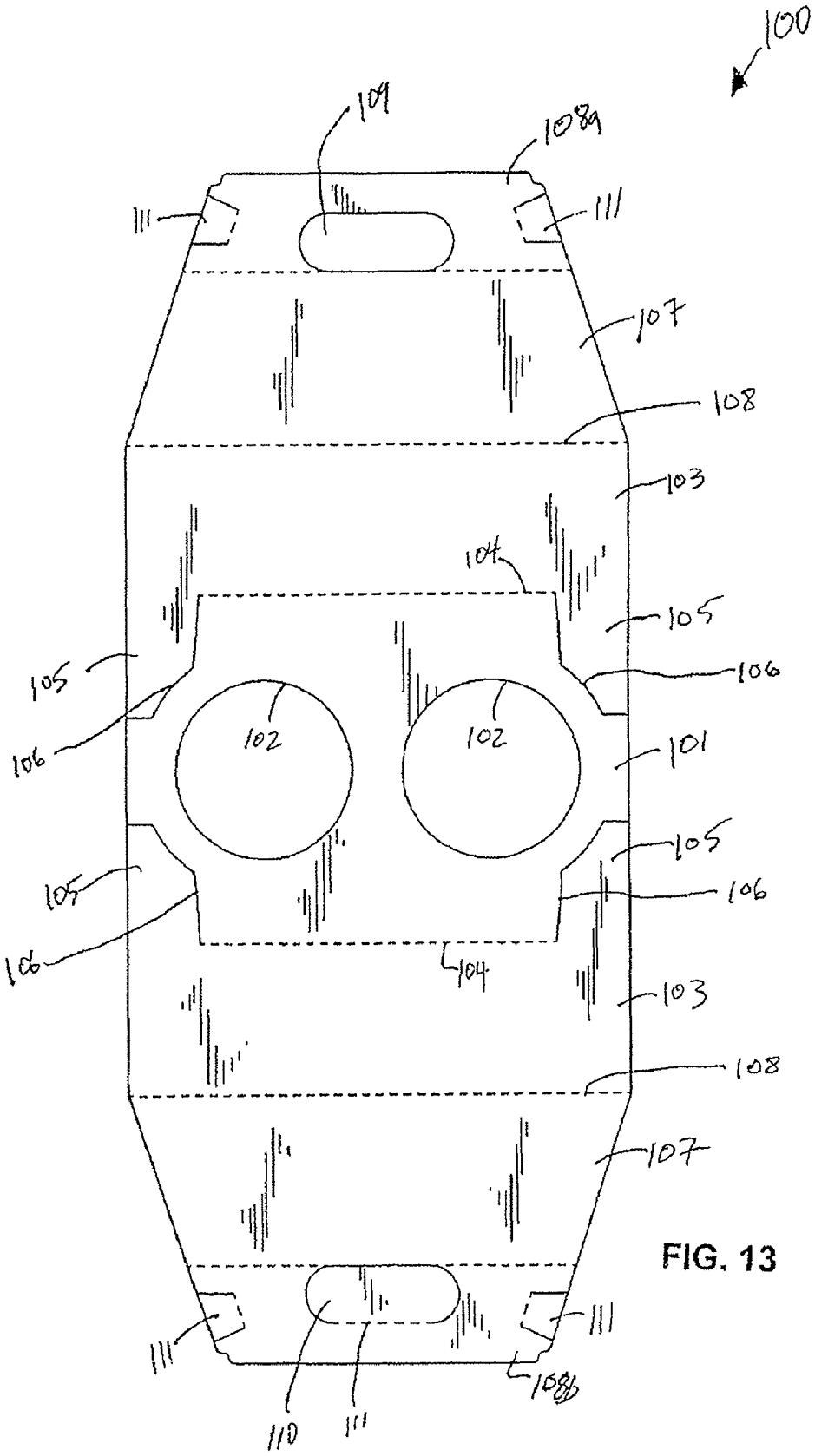
FIG. 13 is a top plan view of the cardboard blank from which the cup carrier of FIG. 12 is formed.

FIGS. 12 and 13 depict a sixth embodiment of the cup carrier that is designated by reference number 100. This embodiment of the cup carrier includes a base 101 with a number (e.g., two as shown) of circular openings 102 for receiving beverage cups as described above with respect to FIG. 1. The cup carrier 100 includes a pair of upwardly extending support members 103. The support members 103 are connected to the base 101 along fold lines 104 allowing the support members 103 to be folded vertically upward as depicted in FIG. 12. The lower portion of each support member 103 includes two downwardly extending foot members 105. The foot members 105 are formed out of the base 101 by cut out lines 106. The top portion of each foot member 105 is rigidly connected to the support member 103, allowing the foot member 105 and the support member 103 to move as one unit and causing the foot member 105 to extend downward when the cup carrier 100 is in its set up condition. The bottom portion of the foot member 105 extends downward and provides stability and support to the cup carrier 100 when it is placed upon a flat surface, which is independent of, or in addition to, any stability and support provided by the cups themselves when they are in the cup carrier 100.

The outer ends of the support members 103 are connected to roof members 107 along fold lines 108, allowing the roof members 107 to be folded in a converging relation to one another. The fold lines 108 may be at approximately the same height as the top of the cup that is placed in the cup carrier 100 so that the roof members 107 provide downward pressure on the top of the cup in the same manner as the roof members 89 described above with respect to FIGS. 9 and 10. In addition, the roof members 107 are of sufficient dimensions so that when the cup carrier 100 is resting on a flat surface in its set up condition, with cups placed therein, the support members 103 do not contact the cups or otherwise interfere with set up of the cup carrier 100. As depicted in FIGS. 12 and 13, the upwardly converging roof members 107 terminate in handle structures 108*a*, 108*b* oriented in contacted relation to one another. The first handle structure 108*a* includes an elongated slot-like opening 109 of sufficient dimensions to receive the fingers of a person that is carrying the cup carrier 100. The second handle structure 108*b* includes a cut-out tab 110 that is connected to the handle structure 108*b* along fold line 111 and is the same shape as the elongated slot-like opening 109 of the first handle structure 108*a*. The cut-out tab 110 in the second handle structure 108*b* may be slightly larger in size than the elongated slot-like opening 109 in the first handle structure 108*a* and can be folded through the opening 109 and folded upwardly along the outer surface of the first handle structure 108*a*. This structure 108*a*, 108*b* forms an effective handle for the cup carrier 100. The cut-out tab 110 frictionally retains the upper ends of the handle structures 108*a*, 108*b* in adjacent relation and maintains the set up condition of the cup carrier 100. In addition, the handle structure may also include inwardly converging tabs 111 along at least one side edge. These inwardly converging tabs 111 function in the same manner as the tabs 24 described above with respect to FIG. 1. It should be noted that this handle structure 108*a*, 108*b* may be used with other embodiments of the cup carrier, including the cup carrier embodiment described above with respect to FIGS. 9 and 10.

Figure 14:
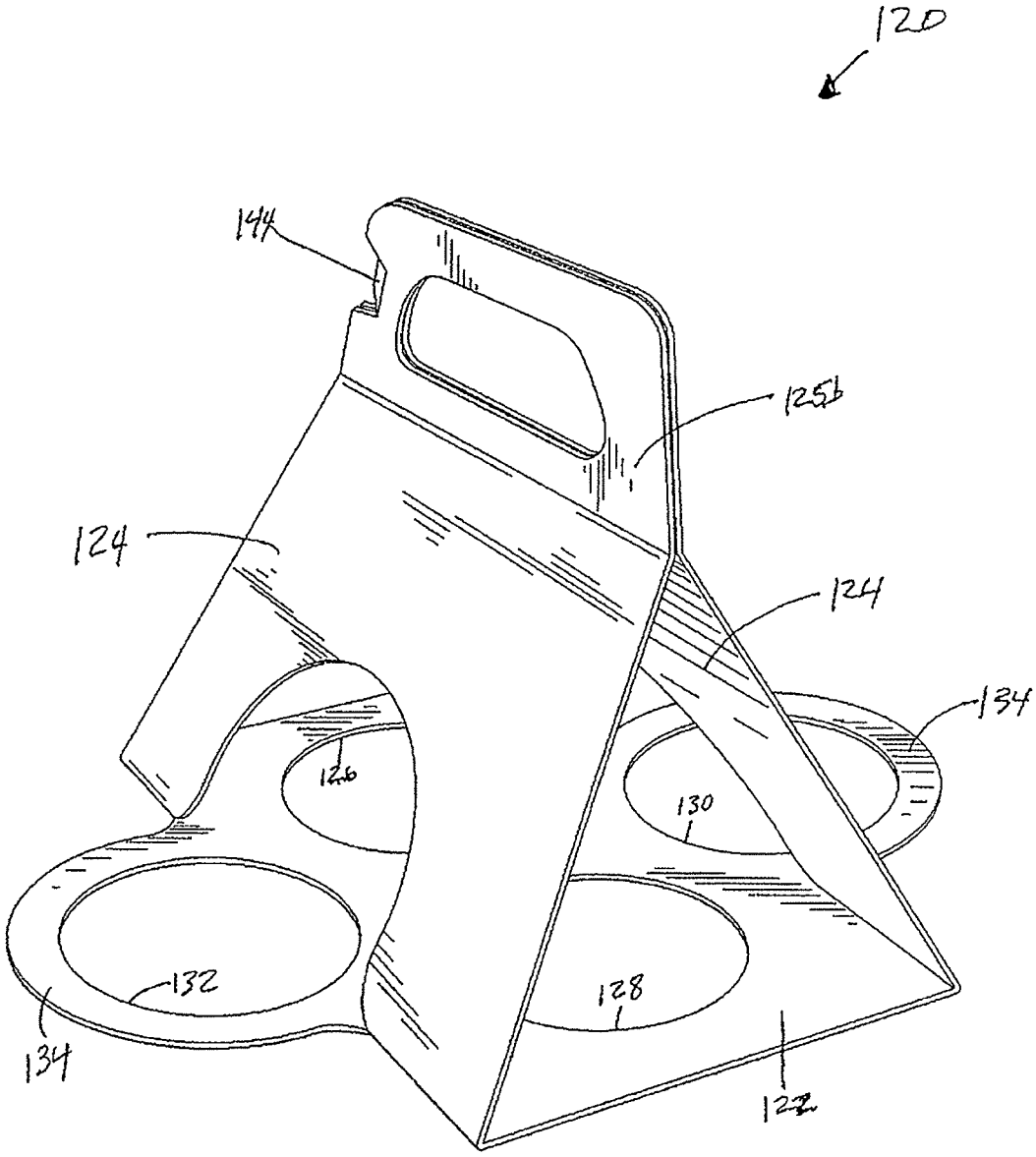
FIG. 14 is a perspective view of a seventh embodiment of a cup carrier in which the base includes four circular openings to receive four beverage cups.
Figure 15:
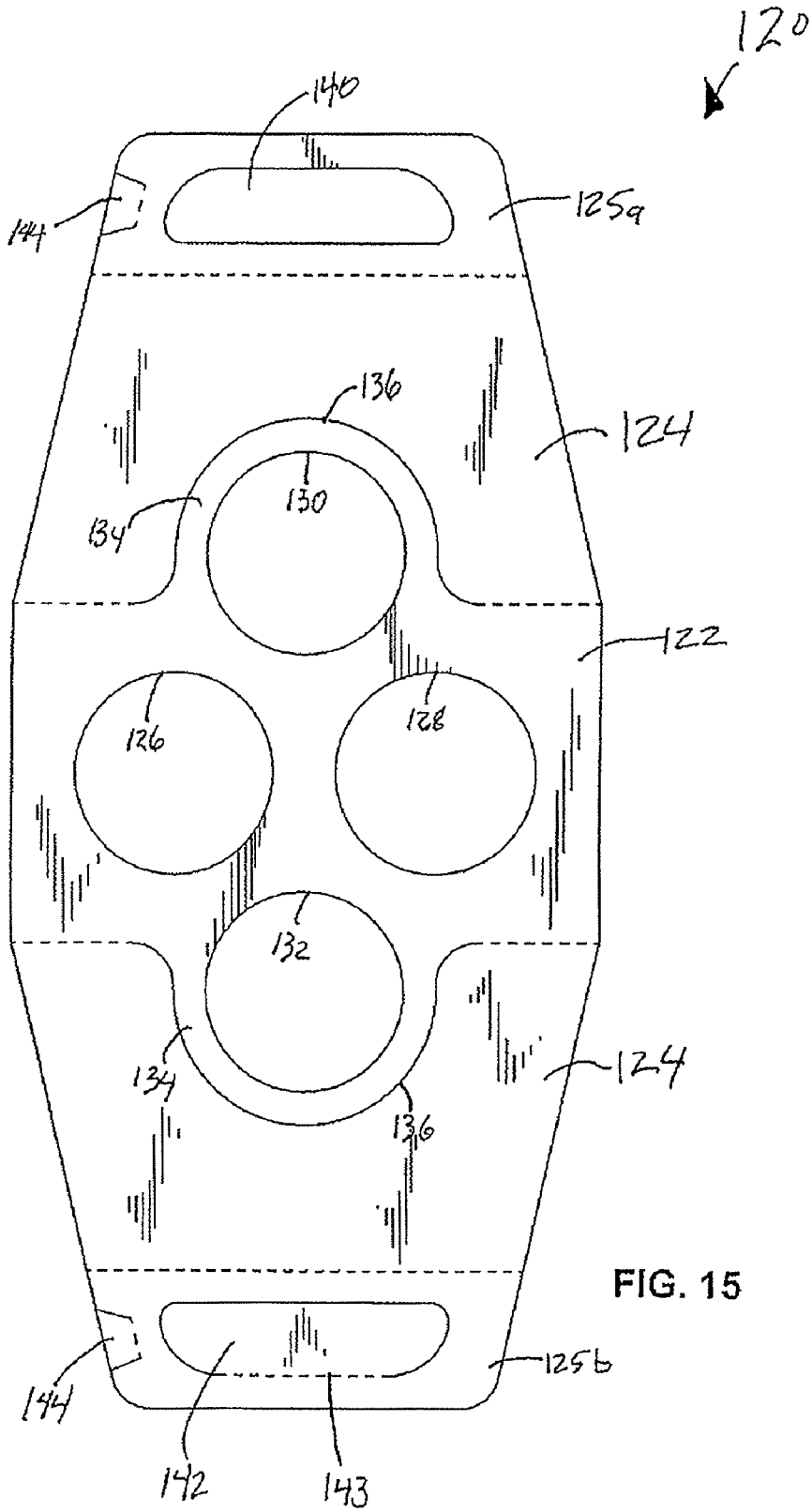
FIG. 15 is a top plan view of the cardboard blank from which the cup carrier of FIG. 14 is formed.

FIGS. 14 and 15 depict a seventh embodiment of the cup carrier that is designated by reference number 120 and is similar in many respects to the first embodiment of the cup carrier 10 described above with reference to FIGS. 1 and 2. The cup carrier 120 includes a base 122 and upwardly converging support members 124 that terminate in handle structures 125*a*, 125*b*. In this embodiment, the base 122 includes four circular openings 126, 128, 130, 132 for receiving beverage cups in a manner similar to that of the first embodiment of the cup carrier 10, depicted in FIG. 1. Two of the openings 126, 128 are formed in the base 122 so that their entire circumferences are within the interior space defined by the upwardly converging support members 124. The remaining openings 130, 132 are defined in part by a portion of the base 122 that forms a partial ring 134 that is defined by cut line 136 between the base 122 and the support member 124 (as depicted in FIG. 15). The partial rings 134 extend outward beyond the interior space between the upwardly converging support members 124 when the cup carrier is in its set up condition, allowing cups to be placed in the openings 130, 132. Openings similar to the ones formed by the partial rings 134 of this embodiment may be added to other embodiments of the cup carrier of the present invention.

As depicted in FIG. 15, the first handle structure 125*a* includes an elongated slot-like opening 140 of sufficient dimensions to receive the fingers of a person that is carrying the cup carrier 120. The second handle structure 125*b* includes a cut-out tab 142 that is connected to the second handle structure 125*b* along fold line 143 and is the same shape as the elongated slot-like opening 140 of the first handle structure 125*a*. The cut-out tab 142 in the second handle structure 125*b* may be slightly larger in size than the elongated slot-like opening 140 in the first handle structure 125*a* and can be folded through the opening 140 and folded upwardly along the outer surface of the first handle structure 125*a*. This structure 125*a*, 125*b* forms an effective handle for the cup carrier 120 and frictionally secures the handle structures 125*a*, 125*b* in adjacent relation to one another. In addition, the handle structures 125*a*, 125*b* may also include inwardly converging tabs 144 along at least one side edge. These inwardly converging tabs 144 function in the same manner as the tabs 24 described above with respect to the first embodiment of the cup carrier 10, depicted in FIG. 1.

Figure 16:
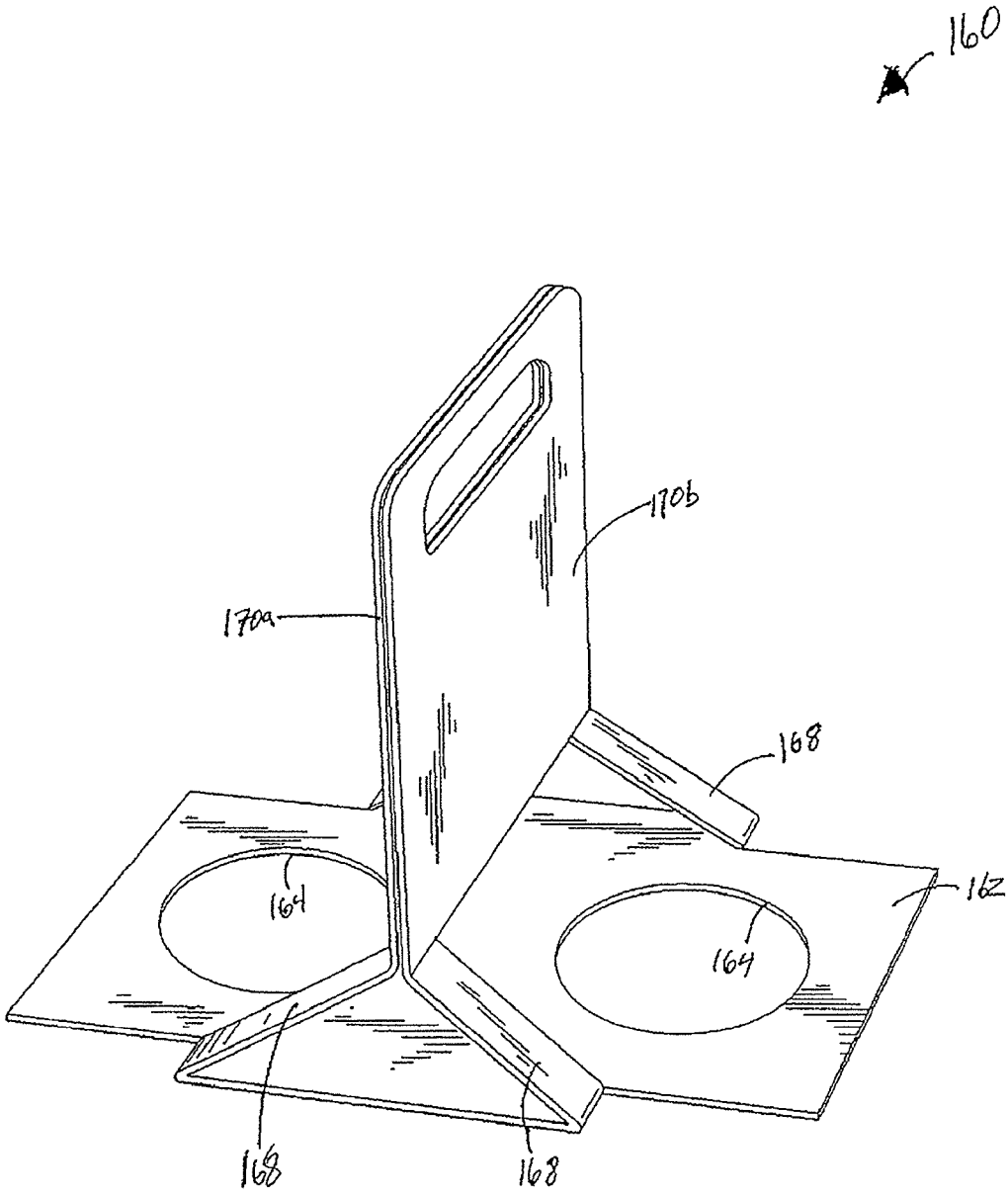
FIG. 16 a perspective view of an eighth embodiment of a cup carrier in set up position.
Figure 17:
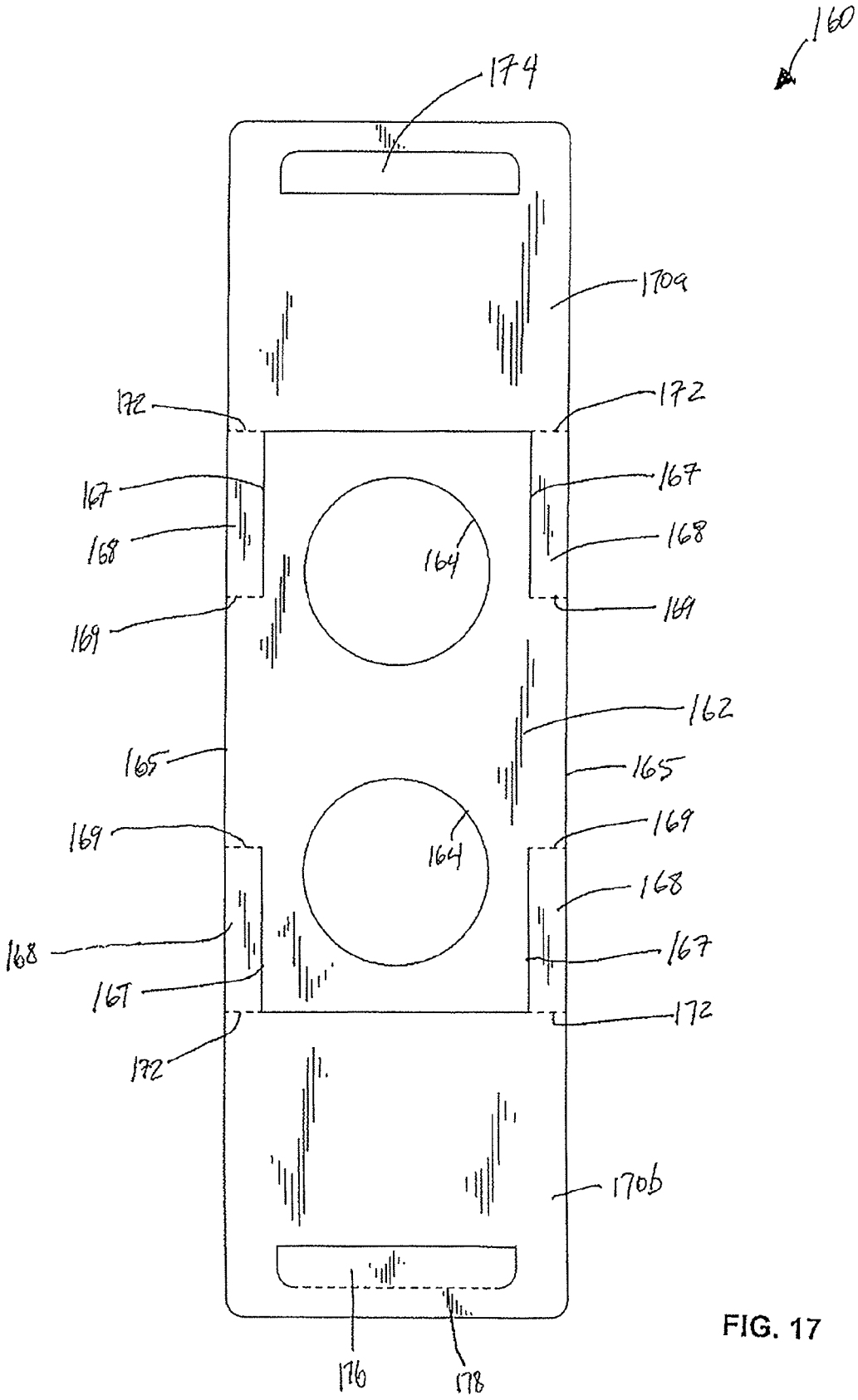
FIG. 17 is a top plan view of the cardboard blank from which the cup carrier of FIG. 16 is formed.

FIGS. 16 and 17 depict an eighth embodiment of the cup carrier that is designated by reference number 160. The cup carrier 160 includes a base 162 with a number (e.g., two as shown) of circular openings 164 configured to receive a drinking cup in the manner described above with reference to the first embodiment of the cup carrier 10, depicted in FIG. 1. The base is defined by a pair of side edges 165, located on the outside of the cardboard blank as shown in FIG. 14, and a pair of cut lines 167. Extending upwardly from portions of the base 162 is a pair of upwardly extending support members 168. Each upwardly converging support member 168 is connected to the base 162 by fold lines 169 to enable the support members 168 to be upwardly folded in a converging relation. As illustrated in FIG. 16, a small portion of the base 162 is within the interior space defined by the upwardly converging support members 168, and the portion of the base that is defined by cut line 167, which includes the openings 164, extends beyond the interior space of the support members 168. The support members 168 each terminate at a handle structure 170*a*, 170*b* connected to the support members 168 along fold lines 172. The first handle structure 170*a* includes an elongated slot-like opening 174 of suitable dimension to receive the fingers of a person that is carrying the cup carrier 160. The second handle structure 170*b* includes a cut-out tab 176 that is connected to the handle member 170*b* along fold line 178 and is the same shape as the elongated slot-like opening 174 of the first handle member 170*a*. The cut-out tab 176 in the second handle member 170*b* may be slightly larger in size than the elongated slot-like opening 174 in the first handle structure 170*a* and can be folded through the opening 174 and folded upwardly along the outer surface of the first handle structure 170*a*. This structure forms an effective handle for the cup carrier 160. The cut-out tab 176 frictionally retains the handle members 170*a*, 170*b* in adjacent relation to one another to maintain the set up condition of the cup carrier 160.

Figure 18:
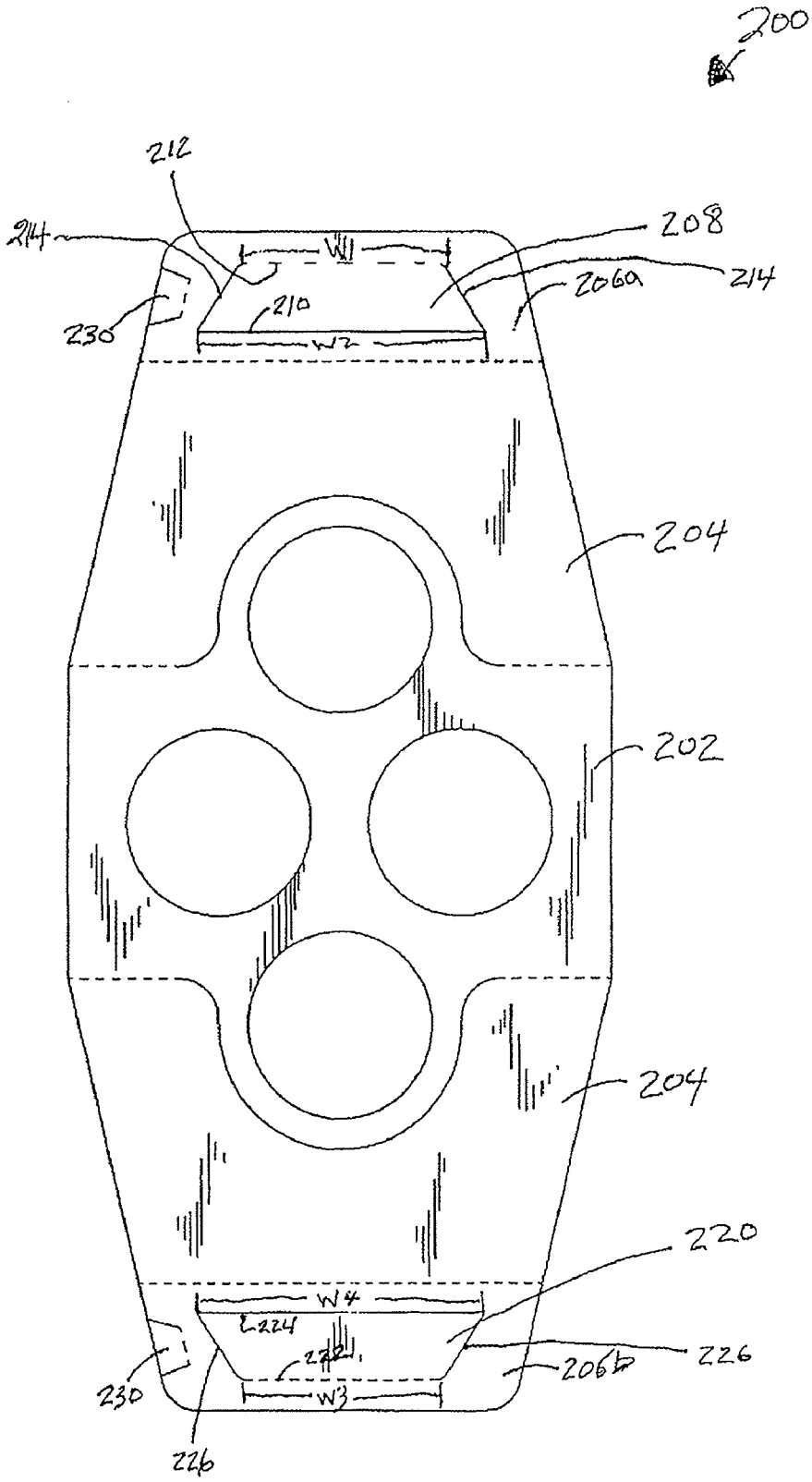
FIG. 18 is a top plan view of a cardboard blank from which a ninth embodiment of the cup carrier is formed.

FIG. 18 is a depiction of a cardboard blank for a ninth embodiment of a cup carrier that is generally designated by reference number 200 and is similar in many respects to the cardboard blank for the seventh embodiment of the cup carrier 120 depicted in FIG. 15. The cup carrier 200 includes a base 202 and upwardly converging support members 204 that terminate in handle structures 206*a*, 206*b*. The first handle structure 206*a* includes a cut-out tab 208 that is connected to the first handle structure 206*a* along fold line 212 which has a width W1. The cut-out tab 208 includes a bottom edge 210 of width W2, W2 being greater than W1, and two upwardly converging side edges 214. The second handle structure 206*b* includes a cut-out tab 220 that is connected to the second handle structure 206*b* along fold line 222, which has a width of W3. In addition, the cut-out tab 220 includes a bottom edge 224 which has a width W4, W4 being greater than W3, and two upwardly converging side edges 226. The opening defined by cut-out tab 208 is of suitable size to receive the fingers of the person carrying the cup carrier 200 and the opening defined by cut-out tab 220 is approximately the same size. When the cup carrier 200 is in its set up condition, the cut-out tab 220 of the second handle structure 206*b* may be pressed against the cut-out tab 208 of the first handle structure 206*a*, folded through the opening defined by the cut-out tab 208 in the first handle structure 206*a*, and folded upwardly. The cut-out tab 220 of the second handle structure 206*b* remains in continued contact with, and overlying relation to, the cut-out tab 208 of the first handle structure 206*a*, causing cut-out tab 208 to be folded upwardly in adjacent relation to the outer surface of the first handle structure 206*a*. Alternatively, the cut-out tab 208 of the first handle structure 206*a* may be pressed against the cut-out tab 220 of the second handle structure 206*b*, folded through the opening defined by the cut-out tab 220 in the second handle structure 206*b*, and folded upwardly. The cut-out tab 208 remains in continued contact with, and overlying relation to, the cut-out tab 220 of the second handle structure 206*b*, causing cut-out tab 220 to be folded upwardly in adjacent relation to the outer surface of the second handle structure 206*b*. This alternative embodiment for the handle structures 206*a*, 206*b* frictionally retains the handle structures 206*a*, 206*b* in adjacent relation to one another and forms an effective handle for the cup carrier 200 and is suitable for use in the handle structures of other cup carrier embodiments of the present invention including the cup carrier embodiments described above with respect to FIGS. 5, 7, 9, 13 and 16. In addition, the handle structures 206*a*, 206*b* may also include inwardly converging tabs 230 along at least one side edge. These inwardly converging tabs 230 function in the same manner as the tabs 24 described above with respect to FIG. 1.

Figure 19:
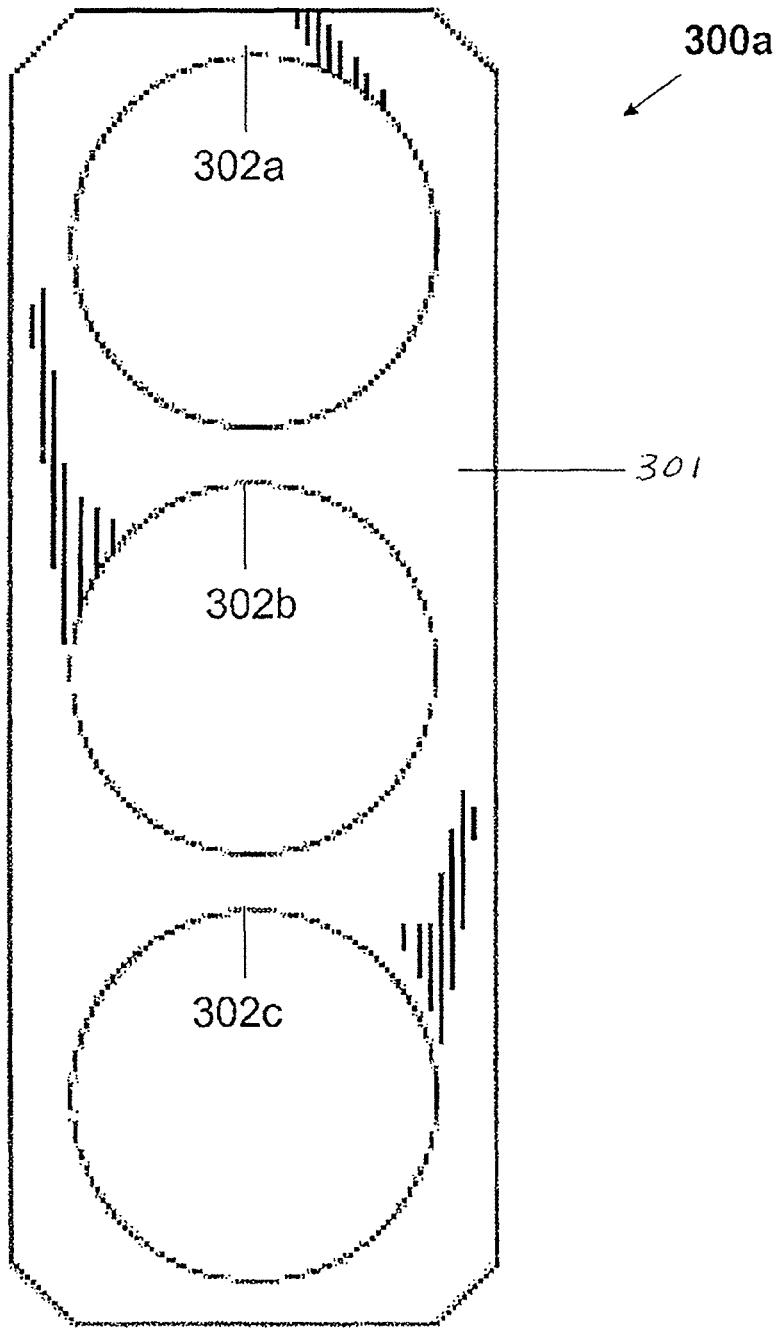
FIG. 19 is a top plan view of a paddle insert with three circular openings.
Figure 19A:
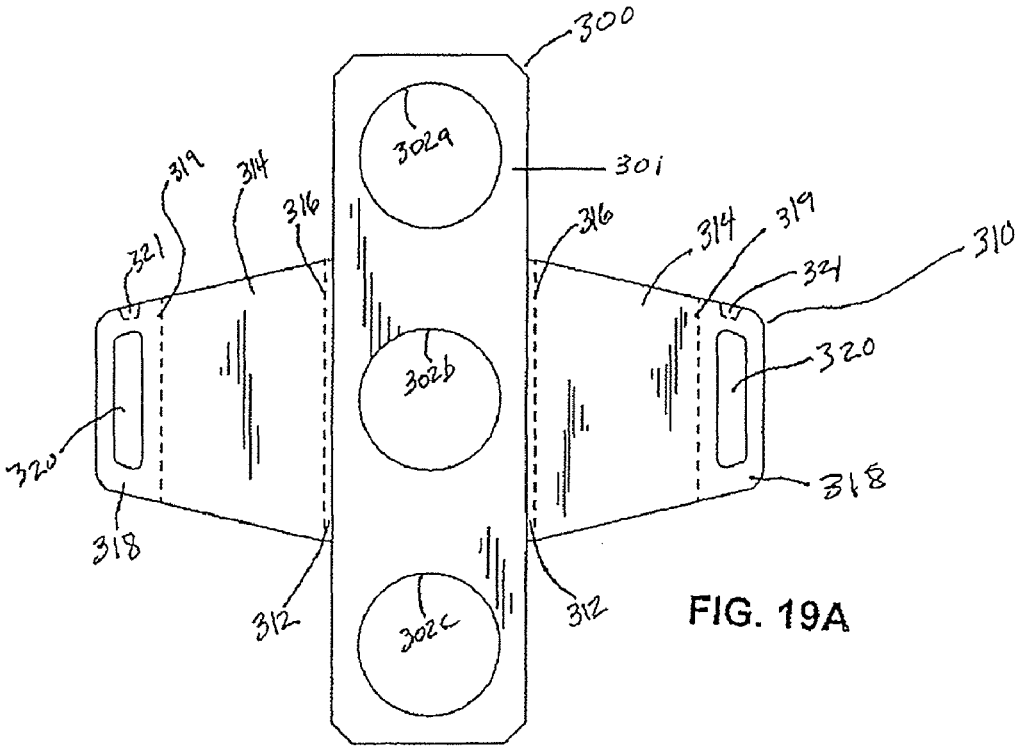
FIG. 19A is a top plan view depicting the use of a paddle insert with three circular openings that is on the base of a cup carrier with a single opening.

FIG. 19 depicts a paddle insert 300*a* for use in conjunction with the cup carrier embodiments of the present invention. The paddle insert 300*a* includes a panel 301 number (e.g., three as shown) of aligned circular openings 302*a*, 302*b*, 302*c*. The openings of the paddle insert 302*a*, 302*b*, 302*c*, are approximately the size of the circular openings in the cup carrier embodiments described above. It should be noted that the openings of the cup carrier embodiments described above and of the paddle insert may be of varying sizes, to accommodate different sized cups. FIG. 19A depicts a paddle insert 300*a* with three circular openings 302*a*, 302*b*, 302*c* that has been placed or slid over the base 312 of a tenth embodiment of the cup carrier 310 that has one circular opening. The cup carrier 310 includes a base 312 that is connected to upwardly extending support members 314 along fold line 316. The upwardly extending support members 314 terminate at a pair of handle structures 318 along fold lines 319. Each handle structure 318 includes an elongated slot like opening 320 for receiving the fingers of the person carrying the cup carrier 310. In addition, the handle structures 318 may include inwardly converging tabs 321 along at least one side edge. These inwardly converging tabs 321 function in the same manner as the tabs 24 described above with respect to the first embodiment of the cup carrier 10, depicted in FIG. 1.

As depicted in FIG. 19A, the paddle insert 300*a* is sized so that its width fits between the support members 314 of the cup carrier and its length extends beyond the base 312 of the cup carrier 310. The paddle insert 300*a* may be placed or slid over the base 312 of a cup carrier 310 so that the center opening 302*b* of the paddle insert 310 and the opening of the cup carrier 310 are superimposed. A cup is placed into the superimposed openings of the paddle insert 300*a* and the cup carrier 310, securing the paddle insert 300*a* to the cup carrier 310. The remaining two openings of the paddle insert 302*a*, 302*c* may receive additional cups, allowing the single cup carrier 310 to hold three cups. It should be noted that although in the paddle insert 300*a* may also be used with other embodiments of the cup carrier that include a single opening.

Figure 19B:
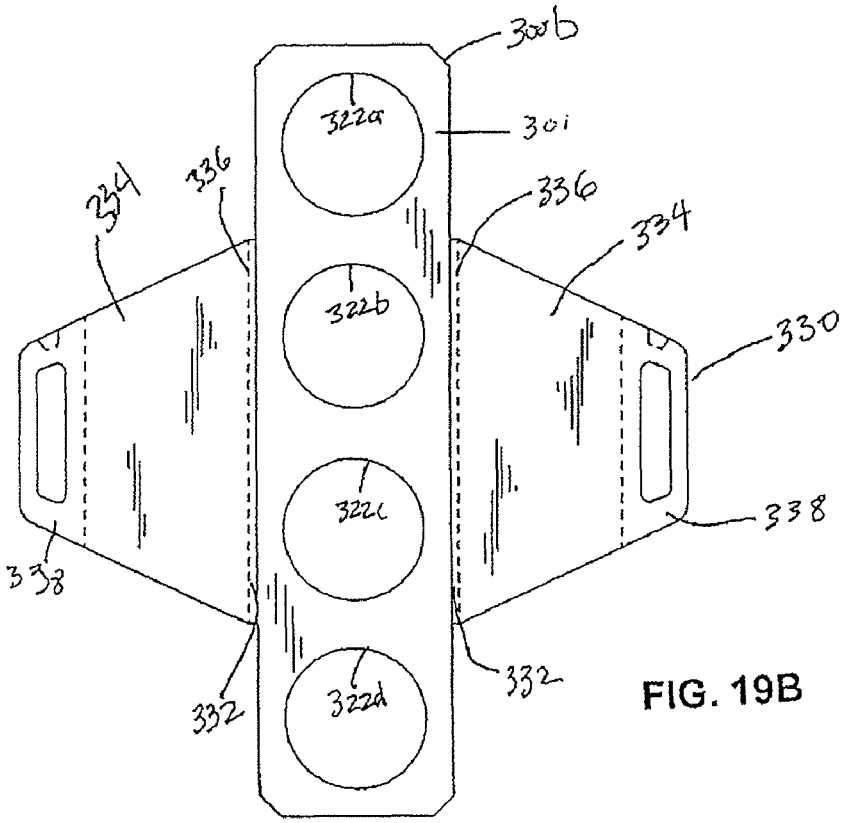
FIG. 19B a top plan view depicting the use of a paddle insert with four circular openings that is on the base of a cup carrier with two openings.

FIG. 19B depicts a paddle insert 300*b* with four circular openings 322*a*, 322*b*, 322*c*, 322*d*. In the illustrated embodiment, the paddle insert 300*b* is placed over a cup carrier 330 that is similar in may respects to the first embodiment of the cup carrier 10, described above with reference to FIGS. 1 and 2. However, it should be noted that the paddle insert 300*b* may be used with other cup carrier embodiments having two circular openings. The cup carrier 330 depicted in FIG. 19B includes a base 332 that is connected to a pair of support members 334 along fold line 336. The support members 334 terminate in a pair of handle structures 338. Like the paddle insert 300*a*, the paddle insert 300*b* has a width that is less than the distance between the support members 334 of the cup carrier 330 and a length that extends beyond the base 332. In this embodiment, the paddle insert 300*b* is placed or slid over the base 332 of a cup carrier 330 so that the two center openings of the paddle insert 322*b*, 322*c* are superimposed with the circular openings of the cup carrier 330. Two cups may be placed into the superimposed openings of the paddle insert 300*b* and the cup carrier 330, securing the paddle insert 300*b* to the cup carrier 330. The remaining two openings 322*a*, 322*d* of the paddle insert may receive additional cups, allowing the original cup carrier 330 with two circular openings to hold four cups once the paddle insert 300*b* is installed.

Figure 20:
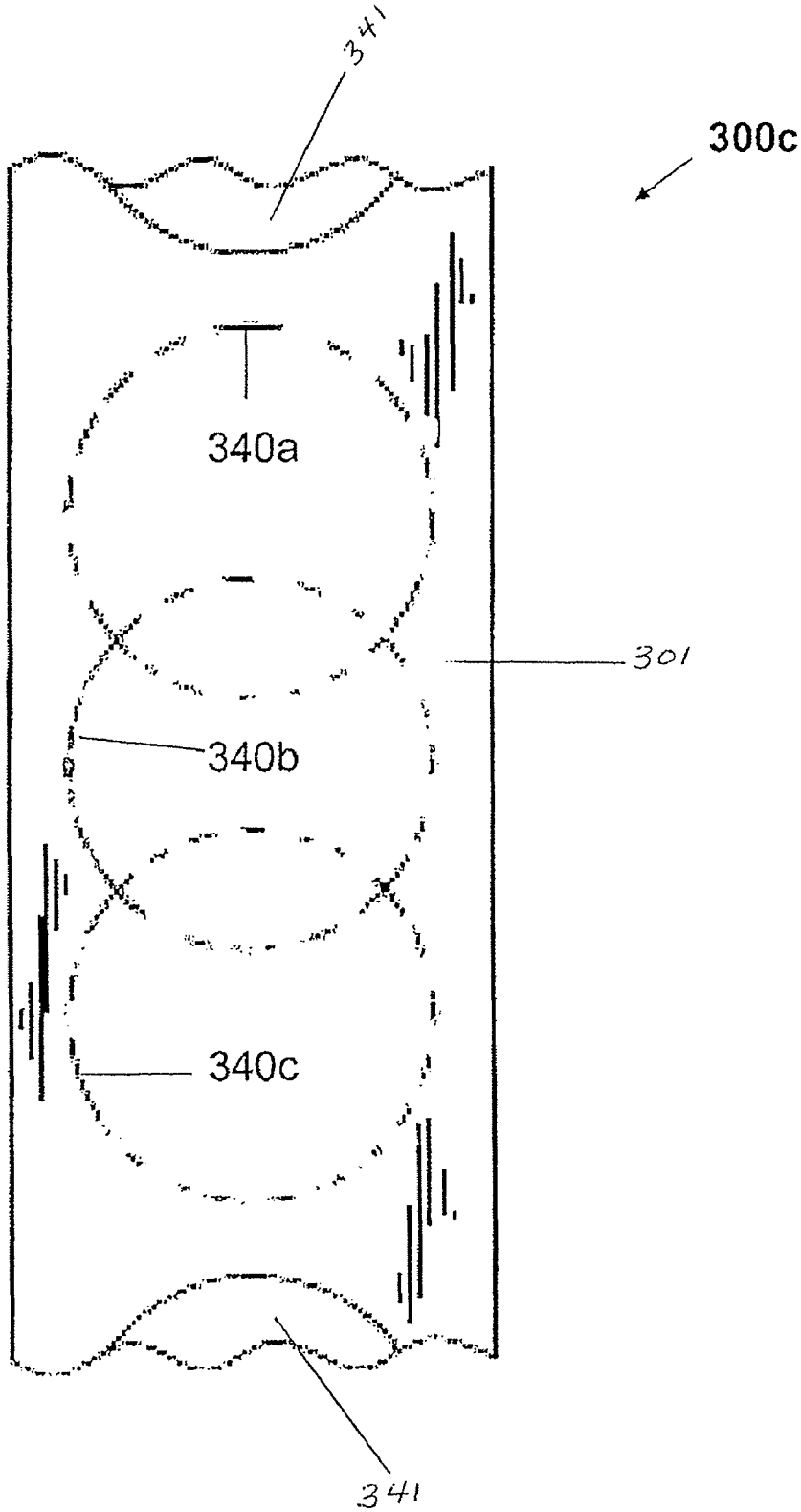
FIG. 20 is a top view of a paddle insert configured with chain link center cut-out tabs.

As depicted in FIG. 20, the center of a paddle insert 300*c* may include a number (e.g., three as shown) of overlapping cut-out tabs 340*a*, 340*b*, 340*c* arranged in a chain link fashion and connected to the paddle insert along perforated edges. The overlapping cut-out tabs are approximately the same size and shape as the circular openings of the cup carrier embodiments described above. As with the previous embodiments of the paddle insert, the paddle insert 300*c* is sized so that its width fits between the support members of the cup carrier and its length extends beyond the base of the cup carrier. The overlapping cut-out tabs 340*a*, 340*b*, 340*c* are configured so that at least one of them is superimposed with the circular openings in the base of a cup carrier when the paddle insert 300*c* is placed or slid over the base of the cup carrier. For example, if the original cup carrier has only one opening, then the paddle insert 300*c* may be placed or slid over the base of the cup carrier so that the overlapping center cut-out tab 340*b* is superimposed with the opening of the cup carrier. A cup may be forced through the cut-out tab 340*b*, removing the cut-out tab along its perforated edge, and through the circular opening of the cup carrier, securing the paddle insert 300*c* to the cup carrier. The remaining openings 341 of the paddle insert 300*c* may receive additional cups. Further, the portions of cut-out tabs 340*a*, 340*c*, that do not overlap with cut-out tab 340*b*, are not removed from the panel 301 when the cup is forced through the tab 340*b*. If the cup carrier has two circular openings, the paddle insert 300*c* may be placed or slid over the base of the cup carrier so that the two outer cut-out tabs 340*a*, 340*c* and the two openings of the cup carrier are superimposed. Two cups may be forced through the cut-out tabs 340*a*, 340*c*, removing the cut-out tabs along their perforated edges, and through the openings in the base of the cup carrier, securing the paddle insert 300*c* to the cup carrier. The remaining openings 341 of the paddle insert 300*c* may then receive additional cups. Further, the portion of cut-out tab 340*b*, that does not overlap with cut-out tabs 340*a*, 340*c*, is not removed from the panel 301 when the cups are forced through the tabs 340*a*, 340*c*.

The foregoing should be considered as illustrative only of the principles of the invention. Since numerous modifications and changes will readily occur to those skilled in the art, it is not desired to limit the invention to the exact construction and operation shown and described. Accordingly, all suitable modifications and equivalents may be resorted to, falling within the scope of the invention.

What is claimed is:

1. A cup and a cup carrier, the cup carrier constructed from a one piece blank of cardboard material, comprising: a beverage cup, with or without a closure lid; a base having at least one opening capable of receiving the beverage cup therein so that at least a portion of the beverage cup extends above the base; support members extending upwardly from opposite side edges of the base and spaced apart from the at least one opening; a roof member extending from each of the support members along a fold line in the cardboard material, the fold lines located an appropriate distance above the base so that when the beverage cup and cup carrier are placed on a flat surface, the fold lines are approximately coplanar with the top of the beverage cup or closure lid so that the roof members are in contact with the top of the beverage cup or closure lid, and a handle forming member at an upper end of each of the roof members, whereby when at least one beverage cup is placed in the cup carrier, the support members are not in contact with the beverage cup or closure lid, and whereby the roof members remain in contact with the top of the beverage cup or closure lid when the carrier is being transported.

2. The cup carrier as claimed in claim 1, and a first handle forming member including an elongated slot-like opening and a second handle forming member including a cut-out tab, one of the first and second handle forming members connected to each of the roof members, the cut-out tab folded through the elongated slot-like opening in overlying relation to the outer surface of the first handle forming member to retain said handle forming members in adjacent relation to one another.

3. The cup carrier as claimed in claim 1, and a first handle forming member including a cut-out tab and a second handle forming member including a cut-out tab, one of the first and second handle forming members connected to each of the roof members, the cut-out tab of the first handle forming member extending through the opening defined by the cut-out tab of the second handle forming member, and folded upwardly, in overlying relation to the cut-out tab of the second handle forming member, the cut-out tab of the second handle forming member adjacent to the second handle forming member.

4. The cup carrier as claimed in claim 3, wherein the cut-out tabs of the first and second handle forming members each have a bottom edge that is longer than the fold lines which attach the respective cut-out tabs to the first and second handle forming members, and wherein the cut-out tabs of the first and second handle members each have upwardly converging side edges.

5. A cup and a cup carrier, the cup carrier constructed from a one piece blank of cardboard material, comprising a beverage cup, with or without a closure lid; a base having at least one opening capable of receiving the beverage cup therein so that when the cup carrier is in a set up condition with the beverage cup received in the at least one opening, at least a portion of the beverage cup extends above the base; support members extending upwardly from opposite side edges of the base and spaced apart from the at least one opening sufficiently so that the support members are not in contact with the beverage cup; a roof member extending from each of the support members along a fold line in the cardboard material, the fold lines located an appropriate distance above the base so that when the beverage cup and cup carrier are placed on a flat surface, the fold lines are approximately coplanar with the top of the beverage cup or closure lid so that the roof members are in contact with the top of the beverage cup or closure lid, and a handle forming member at an upper end of each of the roof members, whereby the roof members remain in contact with the top of the beverage cup or closure lid when the carrier is being transported.

6. A cup and a cup carrier, the cup carrier constructed from a one piece blank of cardboard material, comprising a beverage cup, with or without a closure lid; a base having at least one opening capable of receiving the beverage cup therein so that when the cup carrier is in a set up condition with the beverage cup received in the at least one opening, at least a portion of the beverage cup extends above the base; support members extending upwardly from opposite side edges of the base and spaced apart from the at least one opening sufficiently so that the support members are not in contact with the beverage cup; a roof member extending from each of the support members along a fold line in the cardboard material, the fold lines located an appropriate distance above the base so that when the beverage cup and cup carrier are placed on a flat surface, the roof members are above the top of the beverage cup or closure lid and are in contact with the top of the beverage cup or closure lid, and a handle forming member at an upper end of each of the roof members, whereby the roof members remain in contact with the top of the beverage cup or closure lid when the carrier is being transported.

* * * * *